US007937781B1

(12) United States Patent
Strech

(10) Patent No.: US 7,937,781 B1
(45) Date of Patent: May 10, 2011

(54) SINK STOPPER ASSEMBLY

(75) Inventor: Kenneth Ray Strech, Banning, CA (US)

(73) Assignee: KR Strech Holdings LLC, Banning, CA (US)

( * ) Notice: Subject to any disclaimer, the term of this patent is extended or adjusted under 35 U.S.C. 154(b) by 1127 days.

(21) Appl. No.: 11/610,354

(22) Filed: Dec. 13, 2006

Related U.S. Application Data

(60) Provisional application No. 60/750,959, filed on Dec. 16, 2005.

(51) Int. Cl.
*A47K 1/14* (2006.01)

(52) U.S. Cl. ..... 4/295

(58) Field of Classification Search ..... 4/286, 293–295; 15/105, 227, 236.01; 215/298
See application file for complete search history.

(56) References Cited

U.S. PATENT DOCUMENTS

| | | | | |
|---|---|---|---|---|
| 1,841,163 | A * | 1/1932 | Trane | 15/236.01 X |
| 2,075,443 | A | 3/1937 | Kirschner et al. | |
| 2,329,242 | A * | 9/1943 | Best | 4/295 |
| 2,643,394 | A | 6/1953 | Wood | |
| 3,427,636 | A | 2/1969 | Seifert | |
| 3,609,776 | A | 10/1971 | Haldopoulos et al. | |
| 4,137,578 | A | 2/1979 | Felici | |
| 4,268,080 | A | 5/1981 | Lindley | |
| 4,297,761 | A * | 11/1981 | Loos | 15/105 |
| 4,409,692 | A | 10/1983 | Ness | |
| 4,504,996 | A | 3/1985 | Loos | |
| 4,745,642 | A | 5/1988 | Shands | |
| 5,377,362 | A | 1/1995 | Jackson | |
| 5,404,596 | A | 4/1995 | Coory | |
| 5,473,782 | A | 12/1995 | Coakley | |
| 5,636,390 | A | 6/1997 | Strech | |
| 7,673,364 | B2 * | 3/2010 | Dombrowski | 15/105 |

* cited by examiner

*Primary Examiner* — Lori Baker
(74) *Attorney, Agent, or Firm* — Knobbe, Martens, Olson & Bear LLP

(57) ABSTRACT

A multi-function device for stoppering and cleaning sinks is provided. The device includes a sink stopper base, a handle, and a scoop extending from the base. The scoop has a curved body and two parallel opposing side edges and a lower edge extending between. Each side edge has an arcuate upper section having a curvature of a first radius, which terminates at the lower surface of the base. The upper curvature in combination with the linear lower section of the side edges facilitate the lower edge of the scoop to deflect without bending backwards when slid across a sink surface. The handle includes a cavity having a downwardly sloped region which provides the users with additional mechanical leverage and control when manipulating the device. In certain implementations, the device incorporates a two-piece design which allows the scooping member to be removed from the base when not in use.

7 Claims, 12 Drawing Sheets

SINK STOPPER ASSEMBLY

CROSS-REFERENCE TO RELATED APPLICATIONS

This application claims the benefit of priority under 35 U.S.C. §119(e) of U.S. Provisional Application No. 60/750,959 filed on Dec. 16, 2005, which is incorporated herein by reference in its entirety.

BACKGROUND OF THE INVENTION

1. Field of the Invention

The present invention relates generally to sink stoppering devices, and more particularly, relates to an ergonomically designed multi-function sink stopper assembly.

2. Description of the Related Art

Over the past several decades, the installation and use of garbage disposal devices has dramatically risen. While these devices provide numerous advantages not attainable by standard sink and drain configurations, they also present numerous additional problems. Most notably, small items such as silverware frequently inadvertently fall into the comminuting chamber of the disposal. If such items are not retrieved before the disposal is activated, the blades of the disposal may be damaged or destroyed. Thus, invention and use of stoppering devices designed to block the entrance to the garbage disposal are known to the public, as such devices prevent items from inadvertently falling into the disposal.

Another significant problem associated with use of garbage disposal devices is that all garbage in the sink must be manually pushed across the sink's surface to the garbage disposal entrance. This forces the user to either dirty their hands to complete the task or else use an item, such as silverware, to scrape the garbage across the sink surface. However, the use of such items may scrape or damage the sink's surface. Thus, invention and use of specialized garbage scooping devices are known to the public, as such devices are used to gather garbage scattered across the sink's surface into a single pile.

Yet another problem is incurred in trying to push garbage through the protective rubber fingers that frequently block the entrance to the comminuting chamber. Again, knives, forks and the like are often used to complete this task despite the fact that they may fall into the chamber and potentially damage the disposal. For a user to effectively eliminate all of these problems, a stoppering, a scooping and a stuffing device are all necessary items. However, it is often inconvenient to store three separate items in the small area surrounding a sink. Thus, there is a need for an improved single device that is capable of scraping garbage from a sink surface, stuffing the garbage into the disposal and stoppering the disposal entrance.

A number of combination sink stopper, scraper and plunger devices have been developed to address this need. One such device has been invented by the applicant and is disclosed in U.S. Pat. No. 5,636,390, which is hereby incorporated by reference in its entirety. The device is a combination sink stoppering, scraping, garbage scooping and stuffing device. The device includes a handle having an inverted U-shape gripping surface. However, it has been recently noted that the curved interior gripping surface of this device coupled with other aspects of the handle design could potentially inhibit users from obtaining the desired mechanical leverage and control while manipulating the device. The scoop portion of the device can also be further improved so that the device can be more effective in scraping garbage across the sink surface.

Thus, it is an object of the present invention to overcome or ameliorate at least one of the disadvantages of the prior art, or to provide a useful alternative.

SUMMARY OF THE INVENTION

The preferred embodiments of the sink stopper device have several features, no single one of which is solely responsible for their desirable attributes. Without limiting the scope of this invention, its more prominent features will now be discussed briefly. However, not all of the following features are necessary to achieve the advantages of the device. Therefore, none of the following features should be viewed as limiting. After considering this discussion, and particularly after reading the section entitled "Detailed Description of the Preferred Embodiments," one will understand how the features of the preferred embodiments provide advantages over prior art devices.

In one embodiment, the invention provides a multi-function device for stoppering and cleaning sinks. The device comprises a base having an upper surface and a lower surface. Preferably, the base is sized to fit snugly in a sink drain opening. The device further comprises a gripping member disposed on the upper surface of the base and a scooping member having a curved body extending longitudinally from a lower surface of the base. Preferably, the scooping member comprises a rubber material. In one implementation, the scooping member has two parallel opposing side edges and a lower edge extending therebetween. Each side edge comprises an arcuate upper section having a curvature of a first radius. Preferably, the curvature terminates at the lower surface of the base. Each side edge also comprises a linear lower section. Preferably, the upper curvature in combination with the linear lower section of the side edges facilitate the lower edge of the scooping member to deflect without bending backwards when slid across a sink surface.

In another embodiment, the invention provides a device for stoppering and cleaning a sink. The device comprises a disc shaped sealing member having an upper and lower surface, wherein the sealing member is adapted to sealingly engage with the walls of a sink drain opening. The device further comprises a handle disposed on the upper surface of the sealing member. In one implementation, the handle comprises a plurality of sidewalls, a sloping lower wall, and a substantially flat upper wall, wherein the walls together define a cavity adapted to receive a user's fingers. Preferably, the cavity has a wide opening and slopes downwardly from the opening so as to accommodate movement of the user's fingers while allowing the device to maintain a substantially flat upper exterior surface. The device further comprises a curved extension member extending from the lower surface of the sealing member, wherein the extension member comprises two parallel sidewalls.

In yet another embodiment, the invention provides a device for stoppering a sink. The device comprises a disc shaped base member having an upper and lower surface, wherein the base member is adapted to sealingly engage with the walls of a sink drain opening. The device further comprises a gripping member disposed on the upper surface of the base member. Preferably, the gripping member comprises a gripping surface that extends across at least a portion of the upper surface of the base member so as to define a cavity having a lateral facing opening. The cavity is preferably sloped downwardly from the lateral facing opening to an interior end of the cavity.

In one implementation, the height of the cross sectional area of the cavity is substantially the same throughout. In another implementation, the device further comprises an attachment member wherein the attachment member is connected to a lower surface of the base member. Preferably, the attachment member is adapted to releasably attach an extension to the base member, wherein the extension is selected from the group consisting of blades, scoops, and plungers.

In yet another embodiment, the present invention provides a sink stopper and cleaning assembly. The assembly comprises a sink stopper, an extension member selected from the group consisting of scooping, scraping, and plunger devices, an attachment device wherein the attachment device is adapted to align and releasably couple the extension member to the sink stopper. In one implementation, the attachment device comprises a plurality of male and female mating fasteners disposed on the sink stopper and the extension member. Preferably, the attachment device comprises keyways disposed on the extension member wherein the keyways are adapted to mate with corresponding keys disposed on the sink stopper. In another implementation, the extension member has an elastic collar wherein the collar can be elastically attached to a lower end of the sink stopper.

DETAILED DESCRIPTION OF THE PREFERRED EMBODIMENT

Figure 1A:
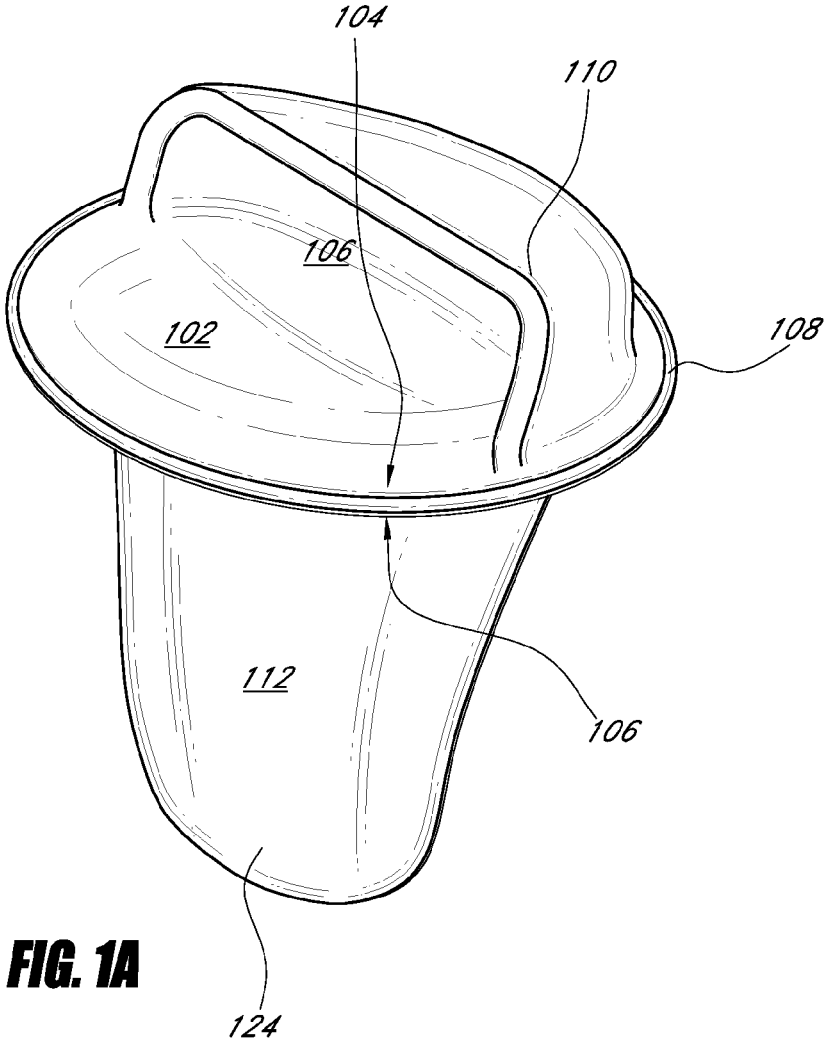
FIG. 1A is a perspective view of a multi-function sink stopper and cleaning device of one preferred embodiment of the presenting invention.

References will now be made to the drawings wherein like numerals refer to like parts throughout. FIG. 1A provides a perspective view of a multi-function sink stopper and cleaning device 100 of one preferred embodiment of the present invention, which is particularly suitable for use in conjunction with a sink equipped with a comminuting device, such as a garbage disposal, that is in fluid communication with the sink drain opening. The sink stopper and cleaning device 100 is designed to be used for multiple purposes including scraping and scrubbing a sink surface to move garbage therein toward the drain opening, stuffing the garbage down through the drain opening to the garbage disposal, and closing the entrance to the drain opening.

As shown in FIG. 1A, the device 100 generally comprises a disc shaped base 102 having an upper surface 104 and a lower surface 106, a sealing member 108 disposed annularly along the periphery of the base 102, a handle 110 disposed on the upper surface 104 of the base 100, and a scoop 112 extending longitudinally from the lower surface 106 of the base 100. In general, the base 102 of the device 100 is configured to fit closely within the entrance to a standard drain opening leading to a garbage disposal in a manner such that the sealing member 108 seals the entrance shut when desired. As it will be described in greater detail below, the handle 110 is disposed on the upper surface 104 of the base 102 and forms a downwardly sloping pocket adapted to receive a user's fingers and to provide a gripping surface for the user.

Figure 1B:
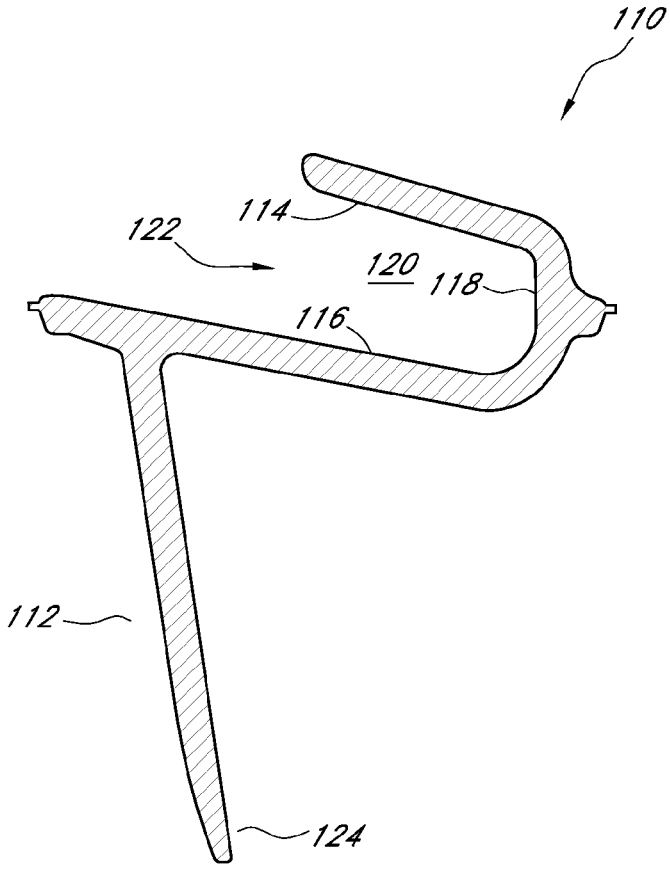
FIG. 1B is a schematic illustration of a partial outline of a side view of the device of FIG. 1A, showing the configuration of the handle.

FIG. 1B provides a schematic illustration of the general contour of the device of FIG. 1A. As shown in FIG. 1B, the handle 110 comprises a generally planar upper interior surface 114, a lower interior surface 116, and interior lateral surfaces 118 extending therebetween. The interior surfaces 114, 116, 118 of the handle together define a cavity 120 having a lateral facing opening 122. In a preferred implementation as shown in FIG. 1B, the upper and lower interior surfaces 114, 116 of the handle each slope downwardly from the opening 122 so as to define a downwardly sloping cavity 120. As it will be described in greater detail below, the lateral facing opening 122 of the handle provides an opening area for user to insert fingers therein for picking up and manipulating the device. The planar upper interior surface 114 provides a large gripping surface for the user when the user's fingers are inserted into the handle. The planar gripping surface in combination with the downwardly sloping cavity further provide additional mechanical leverage and control to the user when manipulating the device. In one embodiment, the angle of the slope of the cavity is about 5 to 30 degrees from the horizontal axis, more preferably between about 10 to 15 degrees.

Figure 2:
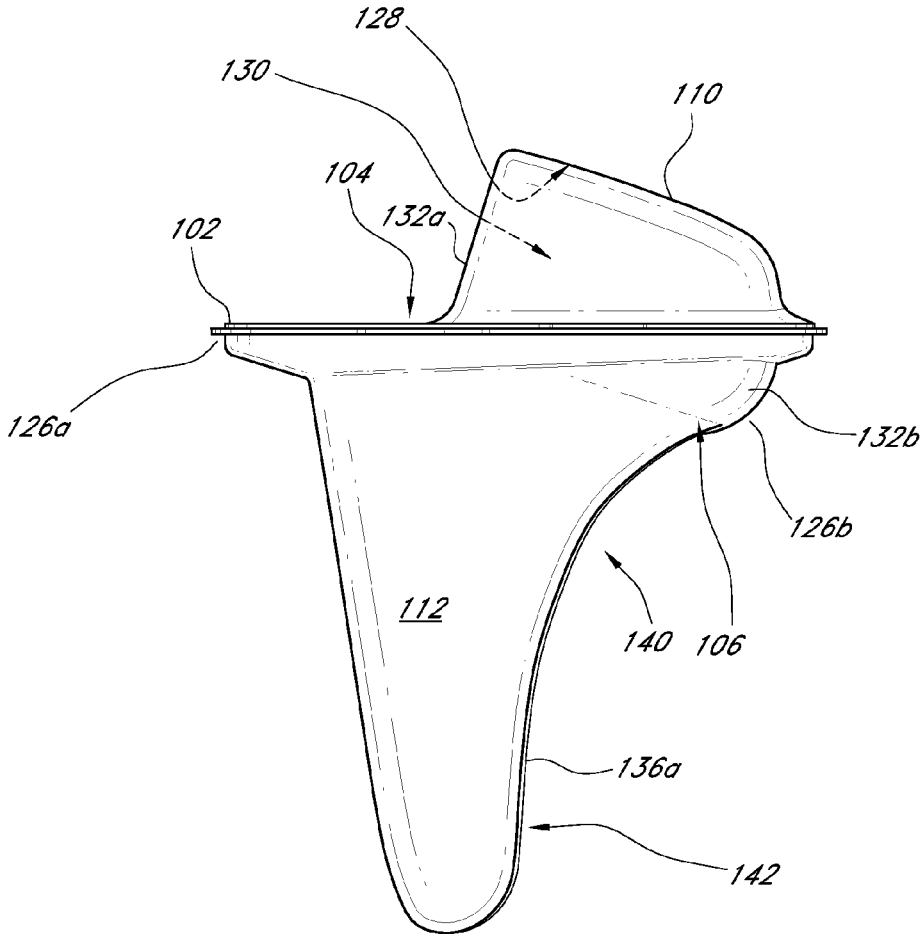
FIG. 2 is a side view of the device shown in FIG. 1.

The device 100 may be fabricated from structural materials such as aluminum, stainless steel but is preferably fabricated from rubbers. In one embodiment, the device 100 is fabricated from a thermoplastic elastomer. In another embodiment, the device 100 is fabricated from a silicone rubber. Preferably, the base 102, the handle, or gripping member, 110 and the scoop 112 are all integrally formed by a molding process. Preferably, the scoop 112 has a curved body 200 as shown in FIG. 2. This material is preferably selected so that the scoop 112, when properly configured, as described below, is sufficiently pliable that a lower edge portion 124 of the scoop 112 is slightly deflected when it is slid across a sink surface but stiff enough so as to not bend backwards. Preferably, the scoop 112 also has sufficient rigidity to permit the user to effectively stuff garbage down into the disposal. In one implementation, the scoop 112 is made of a thermoplastic rubber having a hardness of approximately 70 A. In alternative embodiments, the material selected for the device may have a hardness within the range 40-90 A, or within the range 40-70 A. In yet another embodiment, the material selected for the device comprises a rubber having a specific gravity of approximately 0.89, as measured according to ASTM D792, a tensile strength of approximately 900 psi and an elongation of approximately 750%, as measured according to ASTM D638, and a tear strength of approximately 220 psi, as measured according to ASTM D624.

Figure 3:
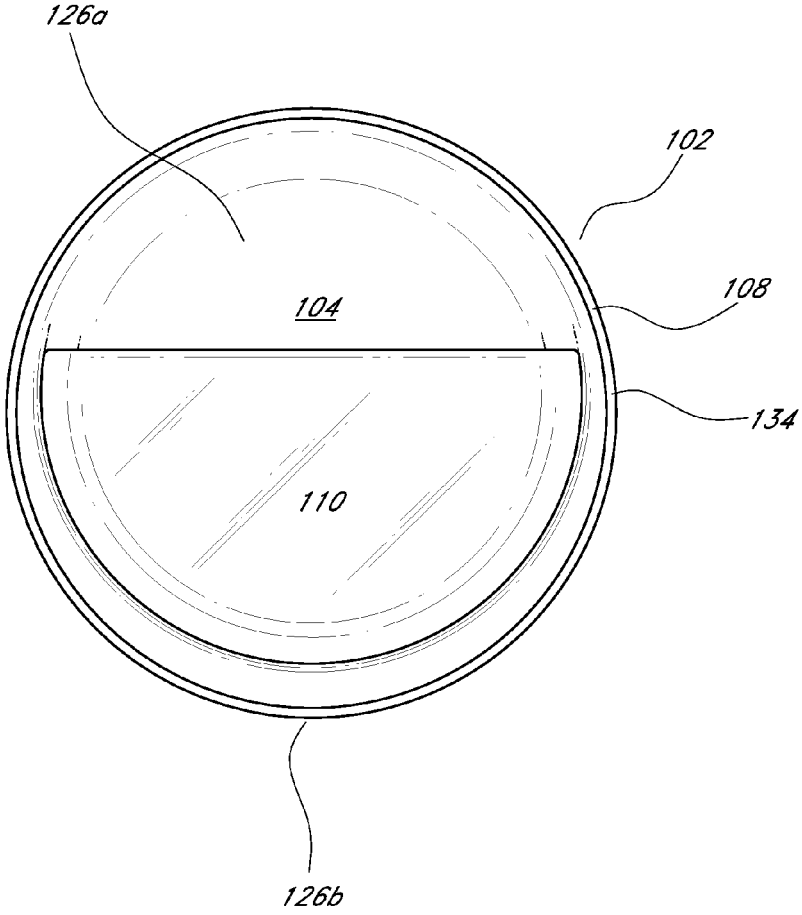
FIG. 3 is a top view of the device shown in FIG. 1.

FIGS. 2 and 3 show that, in one embodiment, the upper surface 104 of the base 102 is sloped, preferably from a front end 126*a* to a rear end 126*b*. In this embodiment, the sloped upper surface 104 of the base 102 also constitutes the lower interior surface of the handle 110 so as to reduce the number of parts and overall weight of the device. As shown in FIG. 2, the sloped upper surface 104 of the base 102 in combination with a sloped gripping surface 128 of the handle 110 define a cavity 130 having a first end 132*a* and a second end 132*b*. In one embodiment, the cavity 130 has a sloped configuration such that an inner section of the cavity has a greater cross-sectional height, which accommodates some degree of freedom of movement of the user's fingers when the fingers are inserted into the cavity. As such, in certain implementations, the handle 110 extending upwardly from and across a portion of the base 102 can have a substantially flat upper surface 128 which in turn provides a more advantageous gripping surface for the user as well as a sleeker appearance for the device. In another embodiment, the cross-sectional height of the cavity remains substantially the same throughout.

As shown in FIG. 2, the upper interior surface 128 of the handle 110 is substantially flat, providing a comfortable gripping surface for an individual using the device. The upper interior surface 128 further slopes downwardly from the first end 132*a* to the second end 132*b*. When the handle 110 is interconnected to the base 102, the downward slope in the upper surface 104 of the base 102 mirrors the downward slope of the upper interior surface 128 of the handle 110. To use the device 100, the user inserts his fingers in the downwardly sloping cavity 130, with the finger tips aligned with the upper interior surface 128 of the handle 110. Because the upper interior surface 128 is substantially flat, the user can easily press his thumb and fingers together to grasp the handle 110. Because the fingers and thumb can perform this motion easily for long periods of time, the device 100 may be used for extended periods comfortably. In another embodiment, the handle has a smooth interior surface that does not contain seams or the like which might detract from user comfort.

As FIG. 3 further shows, the sealing member 108 on the base 102 includes a flange 134 disposed annularly around the base 102. When the device 100 is inserted into a drain, the flange 134 contacts the sidewalls of the drain and forms a seal which inhibits the flow of liquids through the seal. In an alternate embodiment, the base 102 includes at least one straining hole (not shown) so as to allow liquids to enter the drain while still preventing solid objects from passing through the drain and into the comminuting chamber. In a further alternate embodiment, the base 102 might include a valve of a common, well known type used in commercially available drain stoppers. In such a valve, a valve stem is usually manually rotatable into either one of two positions. In a first of the two alternate positions, the valve is able to be closed, and in a second of the two alternate positions, the valve is open in order to allow water to pass through.

Figure 4:
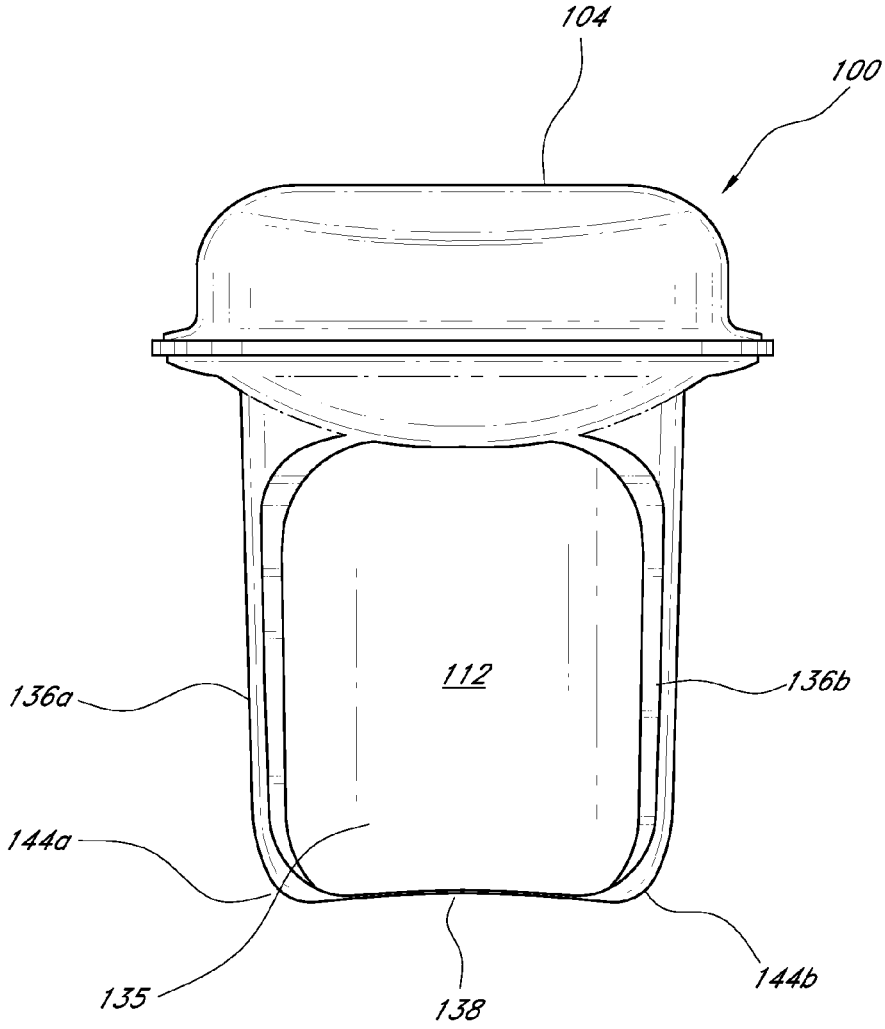
FIG. 4 is a rear view of the device shown in FIG. 1.
Figure 5:
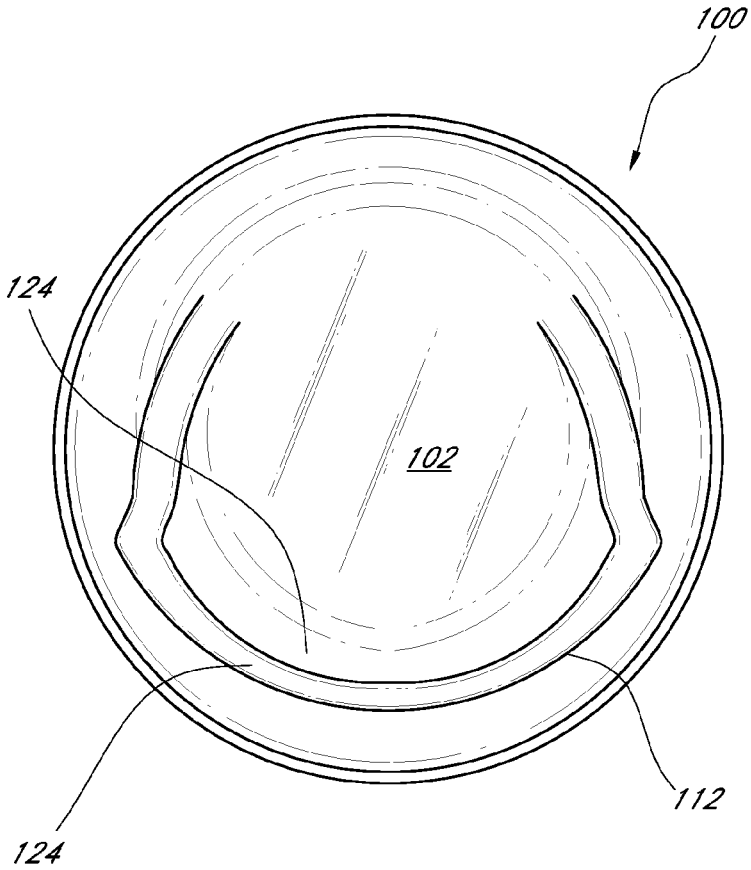
FIG. 5 is a bottom view of the device of FIG. 1.

FIG. 4 illustrates that the scoop 112 comprises a generally U-shaped channel 135 defined by two opposing side edges 136*a*, 136*b* and a horizontal lower edge 138 extending therebetween. Referring back to FIG. 2, one will see that each side edge 136*a*, 136*b* has a curved upper section 140 of a first radius extending directly from the lower surface 106 of the base 102. Preferably, the first radius is selected to substantially maximize the scooping surface to pick up debris and the like when the device is slid across a sink surface. Each side edge 136*a*, 136*b* also has a straight lower section 142. Preferably, the opposing side edges 136*a*, 136*b* are generally parallel to each other as shown in FIG. 4 so as to provide greater scooping surface and structural integrity.

Figure 6:
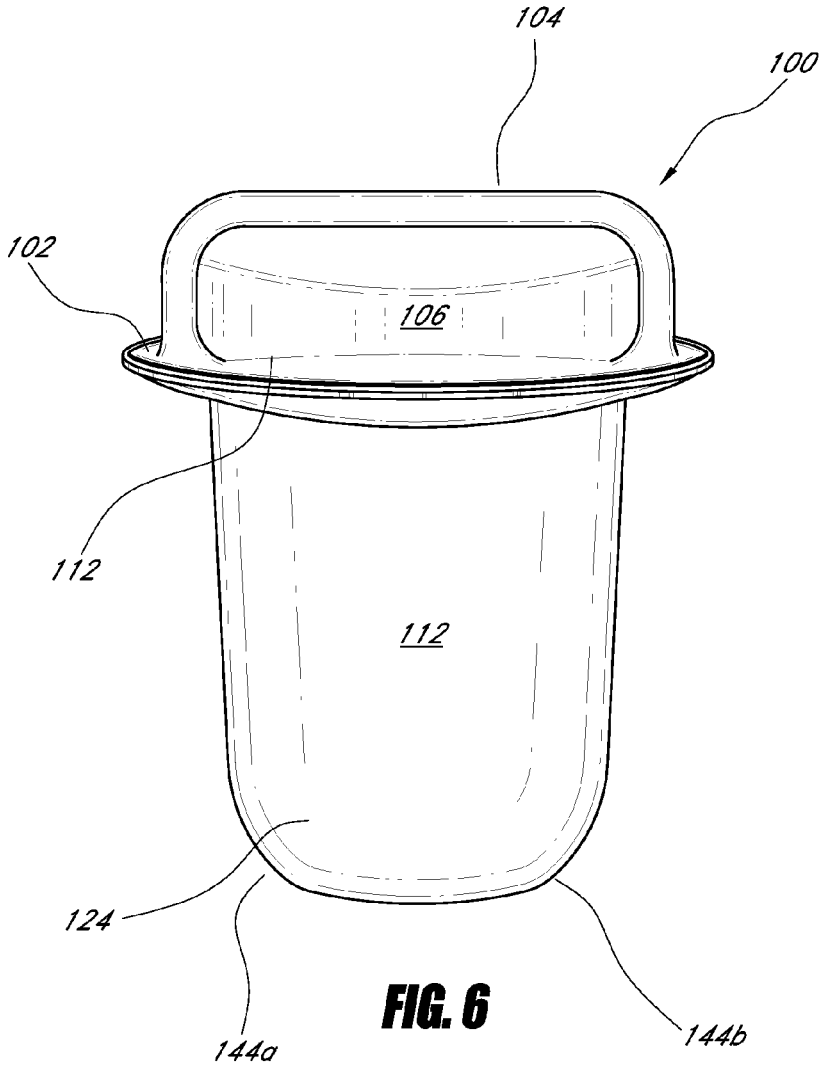
FIG. 6 is a front view of the device of FIG. 1.

The scoop 112 is designed to allow debris to be picked up and carried within the scoop 112. The diameter of the scoop 112 is configured such that when the device 100 is inserted into a drain with the scoop 112 first, the scoop 112 may fit easily within the drain. Advantageously, the rubber construction of the device 100 substantially prevents the device 100 from damaging delicate surfaces when scooping debris. In further advantage, the rubber construction of the device 100 allows the scoop 112 to be deflected from its rest position in order to facilitate the scooping action in removing debris. In another advantage, the rounded corners 144*a*, 144*b* of the scoop 112 as shown in FIGS. 4 and 6 substantially prevent the device 100 from causing injury if pressed against an individual's skin, which is common with sharp edges.

The geometry of the scoop 112 is configured to play a role in the functionality of the device 100. As discussed above, the upper sections 140 of the side edges 136*a*, 136*b* have a curvature with a radius. The upper end of the curvature terminates on the lower surface 106 of the base 102. The radius and location of termination of the curvature are preferably predetermined in order to provide a compromise between the deflection attainable from the scoop 112 and necessary structural support. In one embodiment, a scoop with a very small radius of curvature, terminating very close to the rear end 126*b* of the base 102 will be capable of small deflection and carry a large weight of debris before bending upon itself. In another embodiment, a scoop 112 with a very large radius of curvature, terminating very far from the rear end 126*b* of the base 102 and will be capable of large deflection and carry a small weight of debris before bending upon itself. In one implementation, the radius of curvature is between about 30-75 degrees.

Figure 7A:
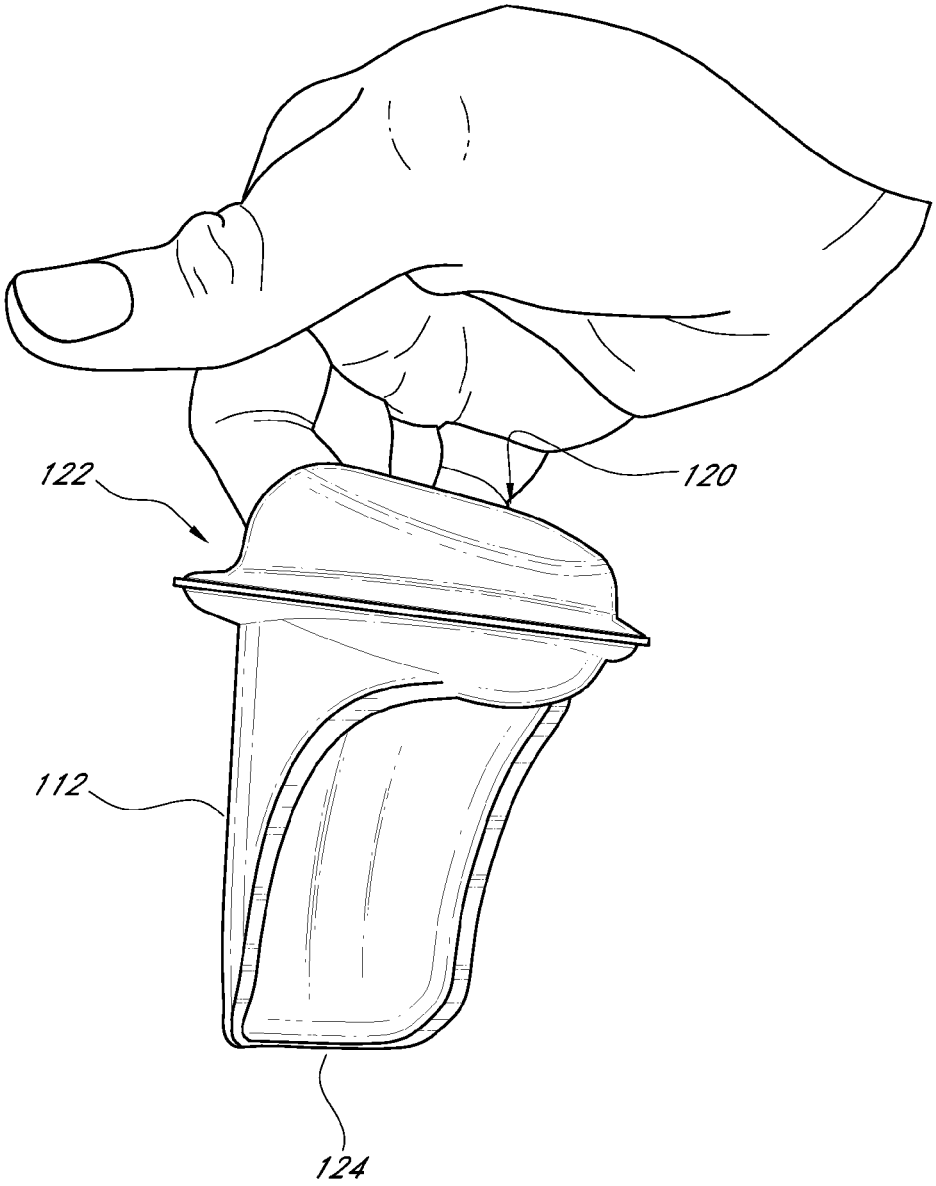
FIGS. 7A-7B illustrate the manner in which the device of FIG. 1 can be picked up and manipulated by the user.
Figure 7B:
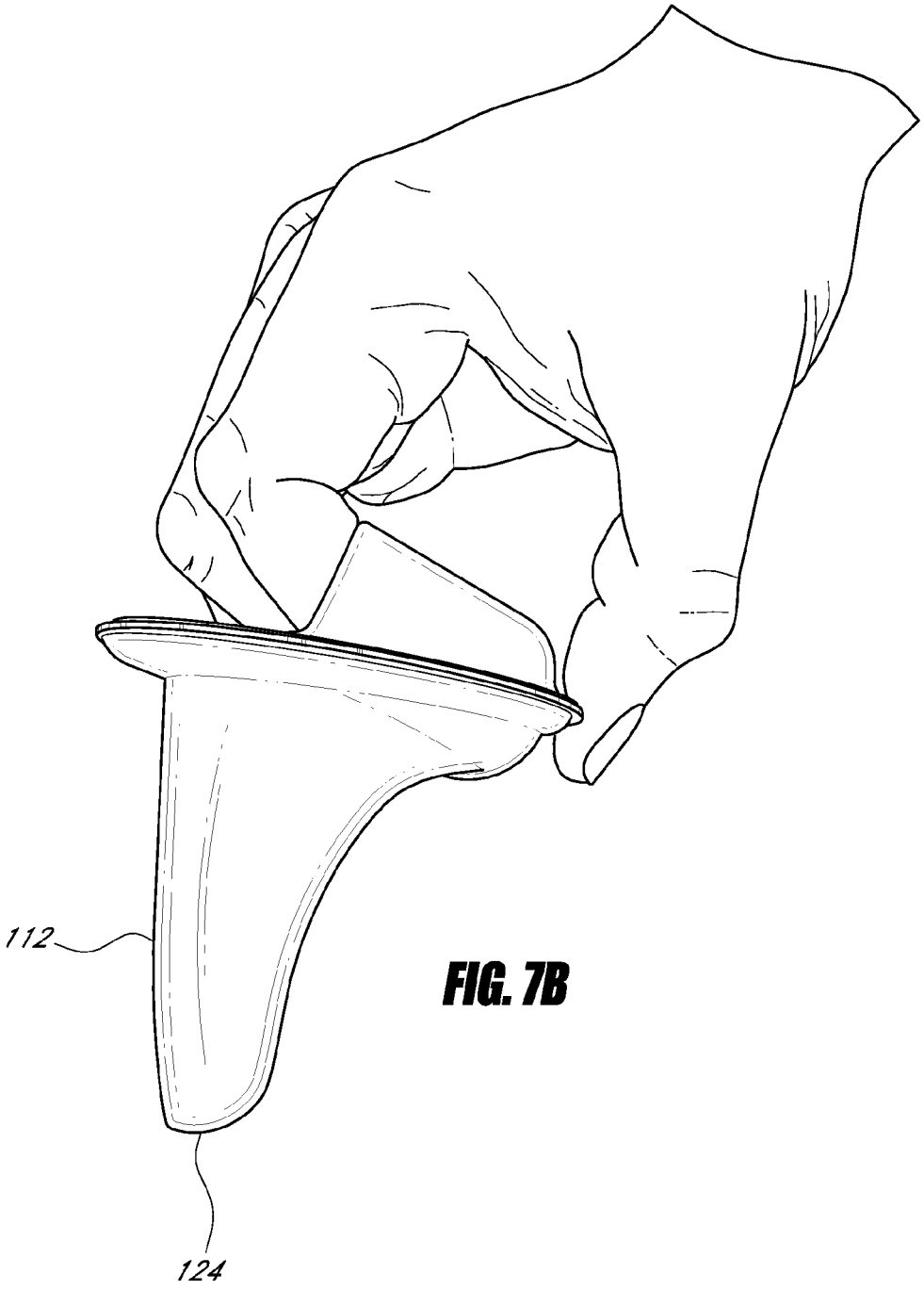

As shown in FIG. 7A, in practice, a user's fingers are inserted into the cavity 120 in a manner such that at least the first segment of all fingers other than the thumb is inserted into the lateral facing opening 122 of the cavity 120. To grasp the device, the user bends the fingers and wraps the hand around the handle in a manner shown in the cross-sectional view provided in FIG. 7B. To scrape debris or garbage from a sink surface toward a drain, the device 100 is positioned so that a lower edge portion 124 of the scoop 112 is in contact with the sink surface. As the device 100 is slid across the sink surface, debris are collected by the scoop 112. The scoop 112 is then inserted into the disposal and used to stuff the debris into the opening leading to the disposal thus depositing the debris cleanly into the garbage disposal. Advantageously, the flat gripping surface and downwardly sloping cavity provide the user with additional mechanical leverage and control as the user manipulate the device. When the user inserts his fingers into a downwardly sloping cavity and grasps the downwardly sloping gripping surface, the user is able to effectuate a wider angle of movement of the scoop when scraping across the sink surface is greater. Additionally, the angled handle also provides the user more mechanical leverage and control when the user is moving the device. The substantially planar upper gripping surface also allows the user's finger tips to be evenly aligned and spread out across the gripping surface, which in turn allows the user to have more control of the device.

Figure 8A:
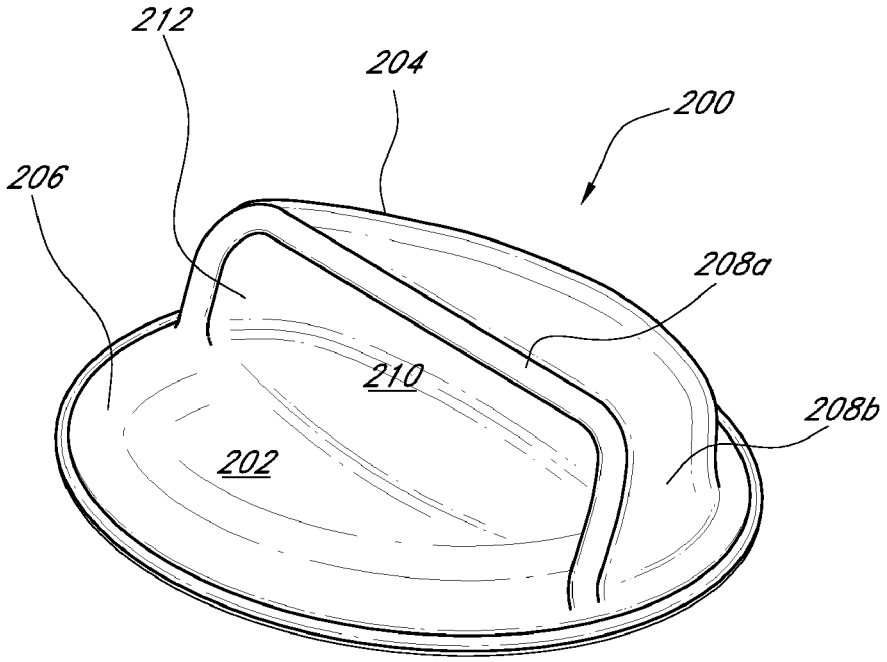
FIGS. 8A-8B illustrate a sink stopper device of another embodiment of the present invention, which does not include an integrally formed scoop.

In certain embodiments, the device can comprise a sink stopper as described above but without the scoop. FIG. 8A generally illustrates a perspective view of the sink stopper device 200 of another embodiment, which is designed without an extension member such as a scoop. As shown in FIG. 8A, the device 200 comprises a disc shaped base member 202 adapted to sealingly engage with a drain opening. The device 200 further comprises a handle 204 disposed on an upper surface 206 of the base 202. The handle 204 comprises a plurality of walls 208*a*, 208*b*, which in conjunction with the upper surface 206 of the base 202, define a downwardly sloping cavity, or interior region, 210 having a lateral facing opening 212. The opening 212 is adapted to provide an area for the user to insert his fingers into the cavity to grasp the device in a similar manner that described above in FIGS. 7A and 7B.

Figure 8B:
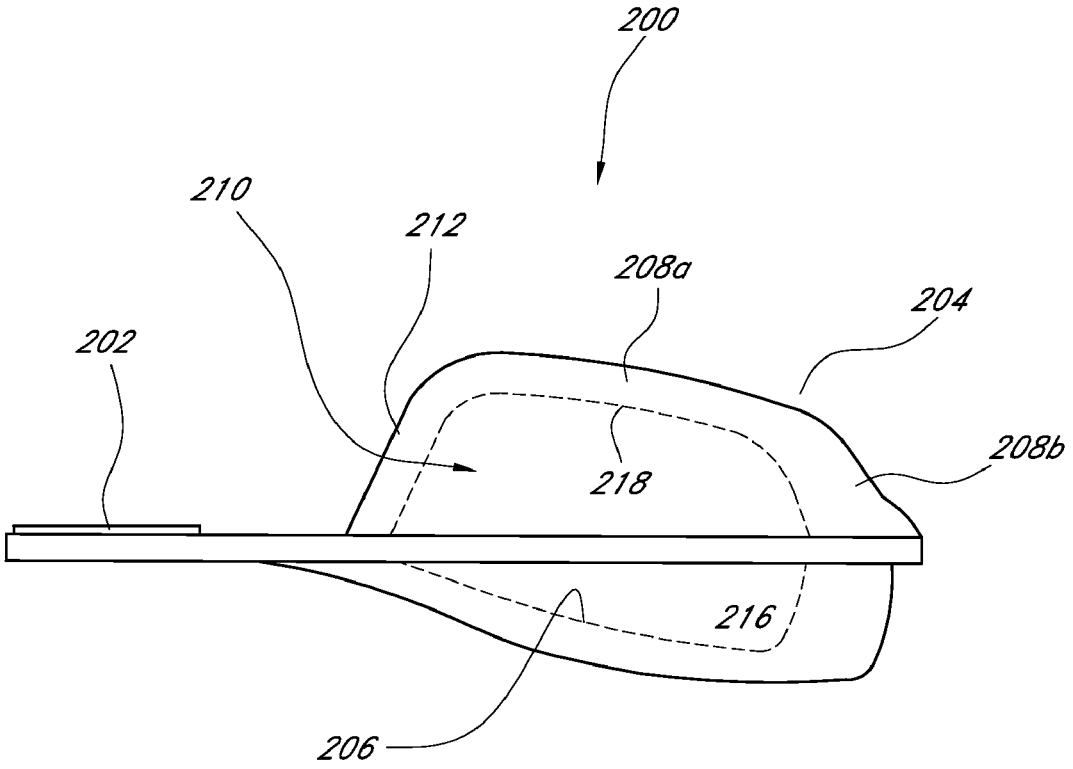

FIG. 8B illustrates a schematic illustration of a side view of the sink stopper 200. As shown in FIG. 8B, the handle 204 comprises an upper wall 208*a* and sidewalls 208*b* which in combination with the upper surface 206 of the base 202 define a pocket or cavity 210 having a downwardly sloped configuration extending from the lateral facing opening 212 to an interior end 216 of the cavity 210. In one embodiment, the angle of the downward slope of the cavity is between about 10 to 30 degrees from the horizontal axis, or between about 5 to 20 degrees, more preferably about 15 degrees. The upper wall 208*a* of the handle is preferably planar so that when a user inserts his fingers into the pocket and presses the fingertips against the interior surface 218 of the upper wall 208*a*, the user's fingers can be positioned level and aligned to each other, which in turn improves the user's comfort and ease in grasping the drain stopper. Additionally, the downwardly sloping cavity in the handle allows the user to obtain a better grip and improved mechanical leverage when removing the sink stopper from the drain opening.

Figure 9A:
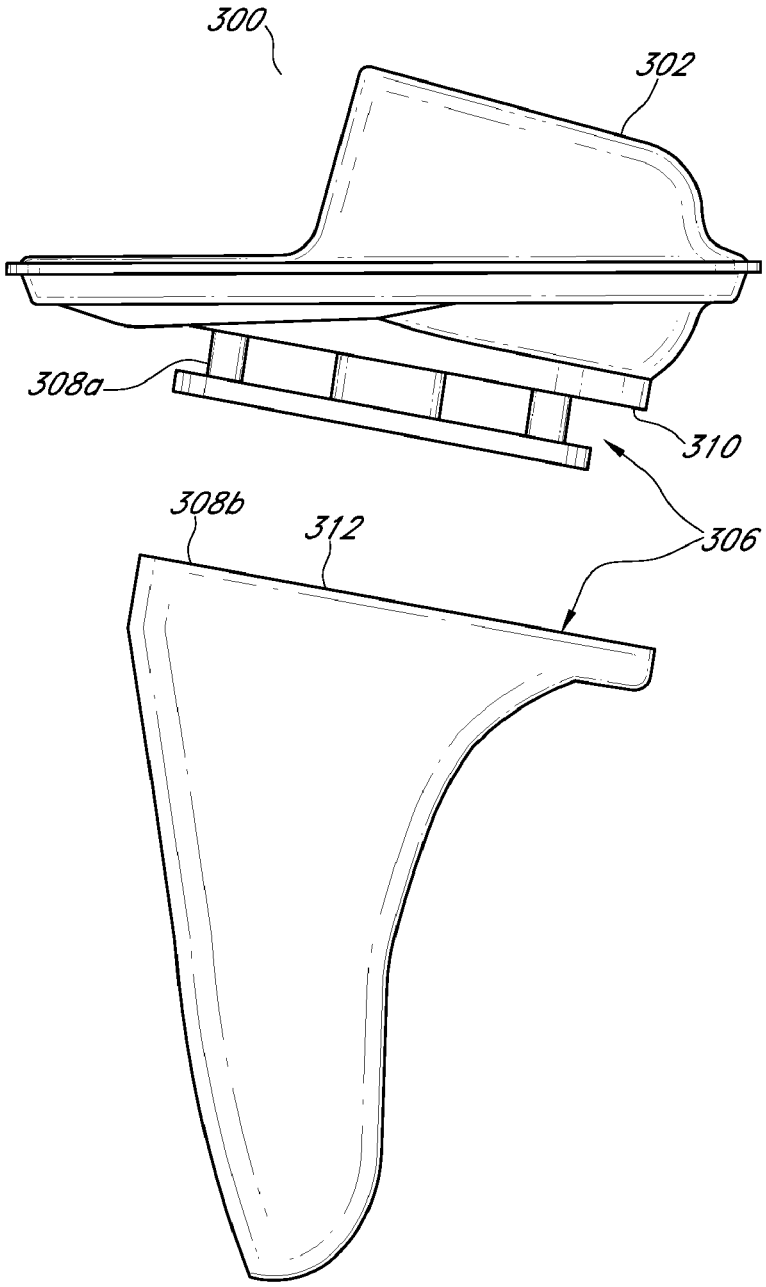
FIGS. 9A-9B illustrate a multi-function sink stopper assembly of yet another embodiment of the present invention.

FIG. 9A illustrates a sink stopper assembly 300 of another embodiment of the present invention. The assembly 300 generally comprises a sink stopper 302, an extension member 304 which can be a scoop, a blade, a plunger device or the like. The assembly 300 further includes an attachment mechanism 306 that is adapted to removably mount the extension member 304 to the sink stopper 302. The general configuration of the sink stopper 302 and the extension member 304 are preferably substantially the same as any of the embodiments described above. The attaching mechanism 306 preferably comprises a set of mating fastener members 308*a*, 308*b* attached to a lower portion 310 of the sink stopper 302 and an upper portion 312 of the extension member 304. The attachment mechanism 306 can utilize a variety of different known fastening mechanisms including but not limited to male/female type fasteners, a screw cap type fastening system using corresponding threads that engage with each other, and the like.

Figure 9B:
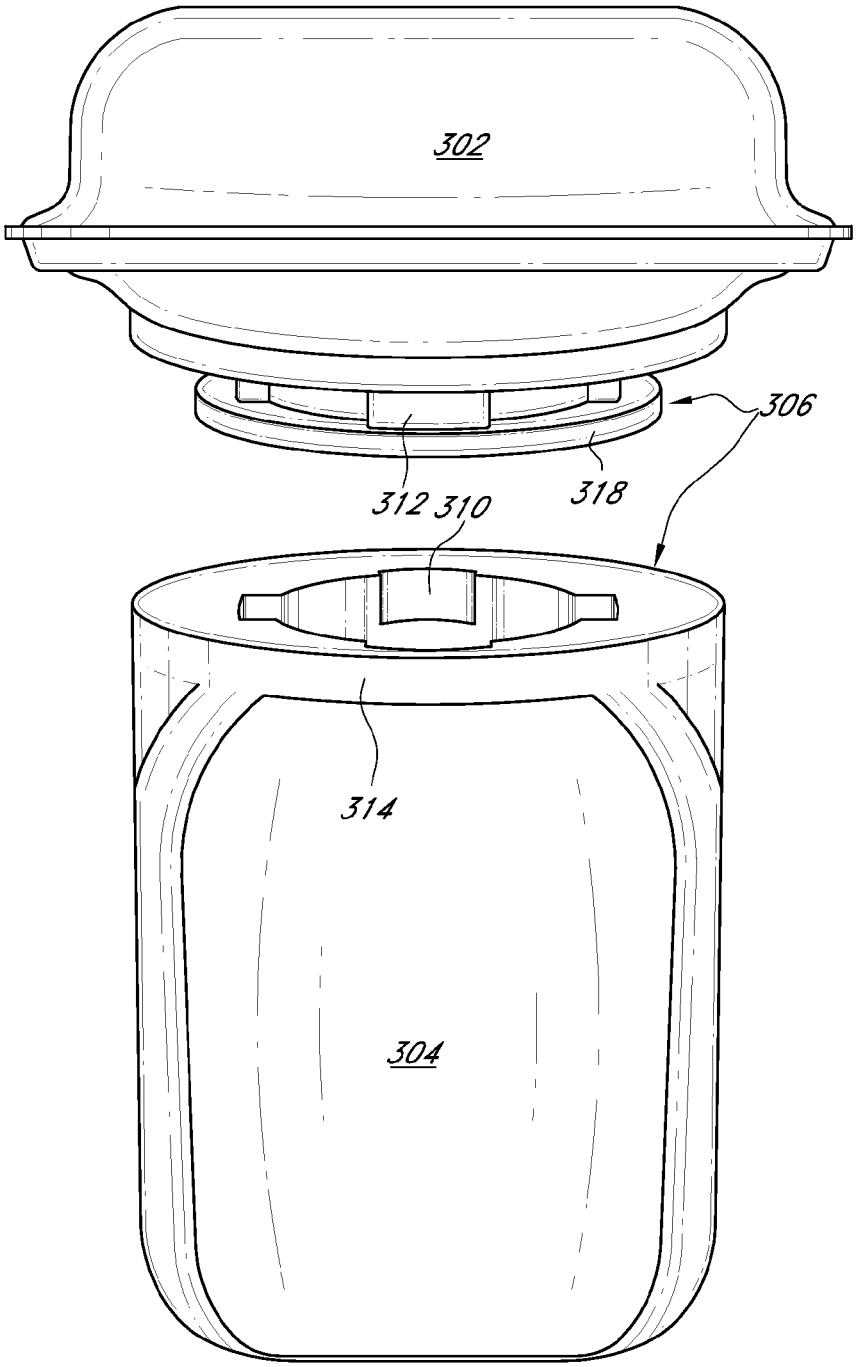

As shown in FIG. 9B, in one implementation, the attachment mechanism 306 comprises a plurality of keyways 310 and keys 312 disposed on the extension member 304 and the sink stopper 302. In one embodiment, both keyways 310 and keys 312 are disposed on the sink stopper 302 and the extension member 304. The keyways/keys on the sink stopper are adapted to align and mate with corresponding keys/keyways located on the extension member. In another embodiment, the male key members 312 are formed on the lower portion of the sink stopper and corresponding female keyway members 310 are formed on the upper portion of the extension member.

Preferably, the extension member 304 is made of an elastic material and has an elastic collar 314 that can be stretched to fit over a flange 318 formed on the lower portion of the sink stopper. In one implementation, the installation and removal of the extension member 304 can be accomplished by stretching the collar 314 of the extension member sideways, such as from one side edge of the extension member toward the other. The flange configuration, along with the key/keyway design feature of the attachment mechanism, allow the extension member to be installed in proper alignment and used for its function without coming off due to the limit of the elasticity of the material selected and the usage force vector profile. The attachment mechanism such as the key/keyway design aspect keeps the extension aligned/oriented correctly for its intended use. The attachment mechanism in this embodiment may, while maintaining the same general method of attachment, change in shape and dimension relationships in the production design via prototyping testing.

Advantageously, the two-piece design shown in FIGS. 9A and 9B can be used as a sink stopper without the extension member attached thereto. In this mode, it will take up less space around the sink area where sink stoppers are generally placed when they are not in use. The extension member may be attached when needed for scooping and stuffing on the disposal side and removed after use. It gives the user an option of either leaving the scoop on permanently or removing it after use. The sink stopper can also be made of various metals with decorative finish options. In some embodiments, the extension member can be a replaceable component that is changed periodically.

Although the foregoing description of the preferred embodiments of the present invention has shown, described and pointed out the fundamental novel features of the invention, it will be understood that various omissions, substitutions, and changes in the form of the detail of the invention as illustrated as well as the uses thereof, may be made by those skilled in the art, without departing from the spirit of the invention. Particularly, it will be appreciated that the preferred embodiments of the invention may manifest itself in other shapes and configurations as appropriate for the end use of the article made thereby.

What is claimed is:

1. A multi-function device for stoppering and cleaning sinks, comprising:

a base having an upper surface and a lower surface, said base is sized to fit snugly in a sink drain opening;

a gripping member disposed on the upper surface of the base; and a scooping member having a curved body and extending longitudinally from the lower surface of the base, wherein the scooping member comprises a rubber material, said scooping member having two parallel opposing side edges and a lower edge extending therebetween, wherein each side edge comprises an arcuate upper section having a curvature of a first radius, said curvature terminates at the lower surface of the base, wherein each side edge has a linear lower section, wherein the upper curvature in combination with the linear lower section of the side edges facilitate the lower edge of the scooping member to deflect without bending backwards when slid across a sink surface.

2. The device of claim 1, wherein the linear lower section of the side edge of the scooping member is at least ½ inches long.

3. The device of claim 1, wherein the scooping member is made of a rubber material having a hardness between 40-70 A.

4. The device of claim 1, wherein the gripping member comprises sidewalls extending from the upper surface of the base and upper wall extending horizontally over a portion of the base so as to define a cavity.

5. The device of claim 4, wherein the cavity having a downwardly sloped inner section.

6. The device of claim 1, wherein the gripping member has a flat upper wall.

7. The device of claim 1, wherein the first radius of the curvature is between about 30-75 degrees.

* * * * *